United States Patent [19]

Sappington et al.

[11] Patent Number: 4,759,730

[45] Date of Patent: Jul. 26, 1988

[54] POLARIZED FUSEHOLDER ASSEMBLY

[75] Inventors: Gayle L. Sappington, Glendale; Angelo Urani, St. Louis, both of Mo.

[73] Assignee: Cooper Industries, Inc., Houston, Tex.

[21] Appl. No.: 467,842

[22] Filed: Feb. 18, 1983

[51] Int. Cl.[4] ..... H01R 13/68; H01R 33/95; H01R 13/642

[52] U.S. Cl. ..... 439/622; 337/198; 337/213; 439/680

[58] Field of Search ..... 339/184 R, 184 M, 186 R, 339/186 M, 147 R; 337/188, 194, 197, 198, 201, 202, 213, 227–231, 233, 237

[56] References Cited

U.S. PATENT DOCUMENTS

| | | | |
|---|---|---|---|
| 1,157,026 | 10/1915 | Meschenmoser | 339/186 R X |
| 2,775,745 | 12/1956 | Eaton | 339/75 M X |
| 3,710,296 | 1/1973 | Urani | 337/213 |
| 3,863,189 | 1/1975 | Urani | 337/213 |
| 3,976,967 | 8/1976 | Magherini | 339/147 P X |

*Primary Examiner*—Gil Weidenfeld
*Assistant Examiner*—Steven C. Bishop
*Attorney, Agent, or Firm*—Nelson A. Blish; Eddie E. Scott; Alan R. Thiele

[57] ABSTRACT

A fuseholder assembly includes a two pole fuseholder having load side and line side sections housing a pair of inline fuses which connect respective load and line side terminals, and a breakaway receptacle that releasably joins the line side terminals to corresponding line conductors. The line side section of the fuseholder includes a boss on one side thereof and the load side section and breakaway receptacle each include mating grooves formed therein. The boss is received within both grooves when the fuseholder assembly is properly assembled to polarize the fuseholder sections with respect to one another and to polarize the attachment of the breakaway assembly to the line side fuseholder terminals.

4 Claims, 1 Drawing Sheet

POLARIZED FUSEHOLDER ASSEMBLY

BACKGROUND OF THE INVENTION

The present invention relates to fuseholder assemblies, and more particularly to a means for polarizing a multi-pole fuseholder assembly for in-line fuses.

Multi-pole fuseholders for supporting a plurality of in-line electric fuses in spaced apart relation are well known in the art. See for example Urani, U.S. Pat. No. 3,710,296 which is assigned to the assignee of the present invention. A two pole fuseholder such as that shown in the Urani patent may include individual line side and load side sections secured together in spaced relation by a separate supporting structure. The supporting structure may include a line side plate releasably fastened to a load side plate for respectively receiving the line side and load side fuseholder sections. Alternately, the respective fuseholder sections and their supporting plates may each be molded as an integral unit so that the two sides "make" or "break" contact simultaneously.

In some applications of two pole fuseholders a dummy fuse may be used in the grounded pole. In such an application, if the fuseholder sections are disassembled and then inadvertently reassembled so that the dummy fuse is in the hot pole there is no protection for the load. As a result, the load may be exposed to damage in the event of an overload or short circuit. It is thus desirable to provide a means for polarizing the load and line side sections of a fuseholder to prevent improper assembly.

Two pole fuseholders utilizing a dummy fuse may also be used in connection with a breakaway receptacle used as a mechanical weak link to physically interrupt the circuit under impact. The breakaway feature is desirable for application in breakaway lighting standards as required by State and Federal highway regulations. When assembled, a male line side fuseholder terminal makes sliding contact with a female receptacle terminal, and it is this contact which parts under impact to break the circuit. As a result, it is also necessary to properly assemble the fuseholder and breakaway receptacle with respect to one another so that a dummy fuse is not inadvertently placed in the hot pole of the receptacle. It is thus desirable to provide polarity between the fuseholder and the breakaway receptacle to insure proper assembly.

SUMMARY OF THE INVENTION

A multi-pole fuseholder assembly for housing a plurality of in-line fuses in spaced apart relation includes a fuseholder having a load side section removably fastened to a line side section and an assembly means for insuring proper polarity between the respective load and line side sections.

The assembly means is engageable between the load and line side fuseholder sections and includes key means in the form of a boss on one of the sections and key-receiving means in the form of a mating groove formed in the other section. When the load and line side sections are initially moved into a position which would provide proper polarization, the boss is received within the groove to permit the sections to move into a fully assembled relation. If, however, the sections are initially moved into a position which would provide improper polarization, the boss prevents the sections from moving into a fully assembled relation. Thus, if either fuseholder section during assembly has been inadvertently rotated 180° into a position which would provide improper polarization, the boss will cause an angular displacement of one of the sections with respect to the longitudinal axis of the fuseholder. This angular displacement prevents fastening of the two sections together by removing the alignment of a pair of holes which would otherwise receive a fastening screw.

The fuseholder assembly may also include a breakaway receptacle for use with a fuseholder to interrupt the circuit upon an impact to a lighting pole or other device utilizing the assembly. The breakaway receptacle is mounted on the line side and includes insulating sleeves housing recessed female terminals for slidably receiving male pin-type line terminals of a fuseholder. The breakaway receptacle is preferably formed as a two line integral unit in contrast to the use of individual receptacles for each of the two lines. This arrangement avoids any potential for an individual single line receptacle breaking away thereby exposing a live terminal on the fuseholder.

Polarization between the fuseholder and the breakaway receptacle may also be provided by the assembly means by molding the boss so that it extends longitudinally between the line side pin terminals, and by providing a mating groove in the breakaway assembly to receive the boss. Thus, if the fuseholder and breakaway receptacle are initially moved into a position which would provide improper polarization, the male terminals of the line side fuseholder section are prevented from telescoping into the sleeves of the receptacle to make contact with the female receptacle terminals since the boss causes a misalignment of the male and female terminals.

The present invention thus provides a fuseholder assembly which includes assembly means for polarizing the line and load side fuseholder sections with respect to one another and for polarizing the attachment of a breakaway receptacle to the line side fuseholder terminals. The assembly means insures proper assembly of these components to avoid potentially hazardous conditions. The assembly may also include a means for rejecting non-class CC fuses.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
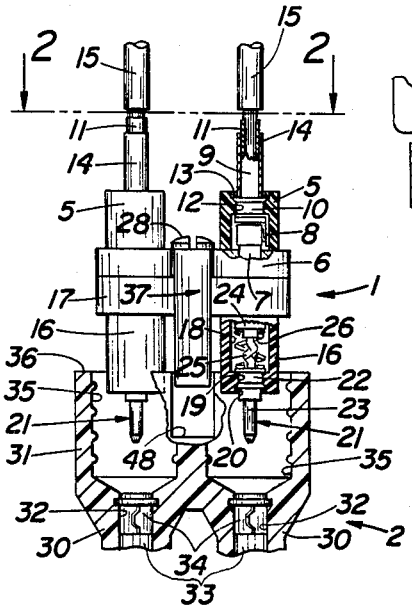
FIG. 1 is a fragmentary side view in elevation with parts broken away and in section of a fuseholder assembly constructed in accordance with the principles of the present invention.
Figure 2:
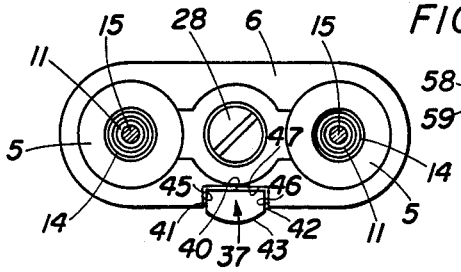
FIG. 2 is a top view of the fuseholder assembly taken along the plane of the line 2—2 of FIG. 1.
Figure 3:
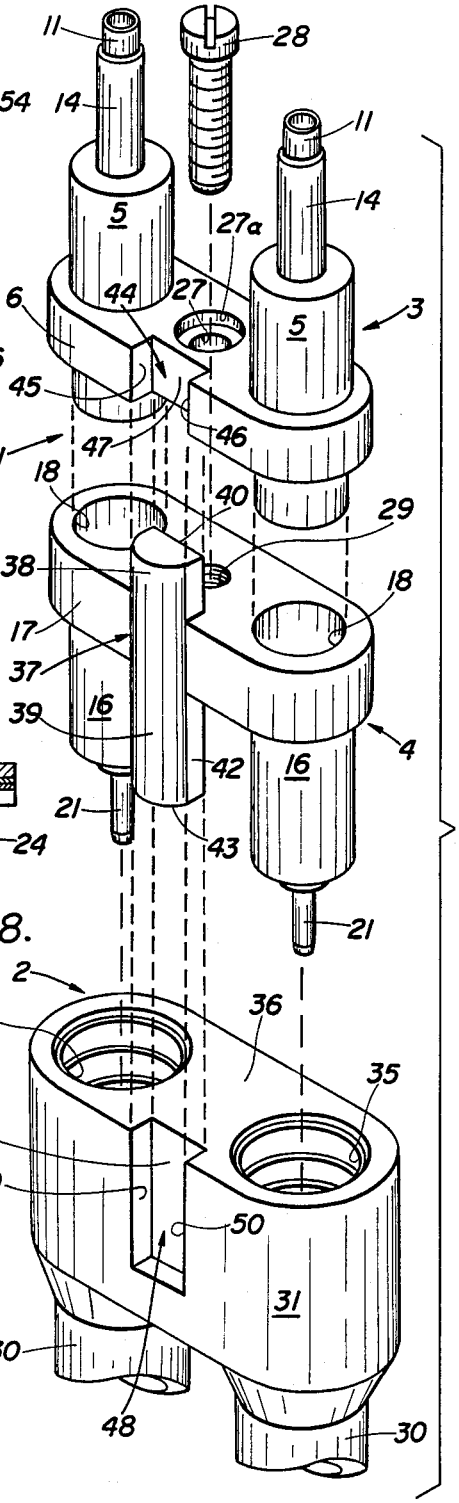
FIG. 3 is an exploded view in perspective showing the manner of assembling the components of the fuseholder assembly.

Referring now to the drawings, FIGS. 1–3 illustrate a fuseholder assembly constituting a preferred embodiment of the present invention. The fuseholder assembly includes a two-pole fuseholder 1 and a breakaway receptacle 2. Although shown as having two poles, the fuseholder 1 and receptacle 2 could be adapted to support multiple fuses in a spaced apart structure.

Fuseholder 1 is utilized to support "in-line" fuses in spaced apart relation for connecting a plurality of adjacent conductor wires. The fuseholder 1 includes a two-pole load side housing or section 3 and a two-pole line side housing or section 4 each molded as an integral unit from an insulating plastic material, such as phenolic resin. The load side section 3 includes a pair of cylindrical bodies 5 disposed in spaced relation and interconnected by a plate or web 6. Each body 5 is open at one end to enable an electric fuse 7 to be inserted and withdrawn therefrom. The fuse 7 is of a conventional type and includes ferrule-like terminals at its opposite ends. As seen best in FIG. 1, one of the fuse terminals will extend into and be held by a holding clip 8 contained within body 5 while the other of its terminals will extend into the line side section 4.

Holding clip 8 is in electrical contact with a copper terminal 9 which has a spool-like inner end 10 and a tubular elongated shank 11 which projects from body 5. The inner end 10 of terminal 9 is dimensioned to fit snugly within a passage 12 in the end wall of body 5 to close off this end of body 5. The holding clip 8 is L-shaped and includes a spring finger on one of its legs which is positioned against the side wall of body 5. Clip 8 also includes an opening in its other leg which is positioned against the end wall of body 5 through which end 10 of terminal 9 extends. The inner end 10 of terminal 9 is of larger diameter than shank 11 and includes a rim or flange at the extreme top and bottom edges thereof. The extreme bottom edge rim is used to press holding clip 8 against the end wall of body 5 and the extreme top edge rim is received within an annular recess 13 formed on the outer end of body 5. A sleeve 14 of insulating material is telescoped over the shank 11 of terminal 9 and extends into the annular recess 13 in body 5 to abut the top edge rim of inner end 10. Sleeve 14 covers the shank 11 of terminal 9 except for the outer edge margin thereof. The extreme top edge rim of inner end 10 of terminal 9 is folded over into the annular recess 13 in body 5 to fixedly secure the terminal 9 and clip 8 to each other and to the body 5. A sealing material 15, such as an epoxy resin, is used to fill the annular recess 13 and provides a water tight seal between the body 5 and terminal 9.

The terminals 9 are tubular in shape so that they easily receive a single conductor wire and have a thickness which enables them to be easily crimped about the ends of the wire conductors 15 which lead to the load to fixedly secure that terminal and the conductors 15 to each other.

The line side section 4 of fuseholder 1 includes a pair of identical spaced apart cylindrical bodies 16 interconnected by a plate or web 17. The body 16 and plate 17 are molded as an integral unit from an insulating plastic material such as a phenolic resin. Each body 16 defines a cylindrical opening 18 which is dimensioned to telescopically receive the inner ends of bodies 5 of load section 3 so that when assembled the opposing faces of plates 6 and 17 are in abutting relationship. A passage 19 communicates with the other end of opening 18 and leads to an annular recess 20 formed in the outer face of body 16.

A copper male pin-type terminal 21 is disposed at the outer end of each body 16. Each terminal 21 includes a spool-like inner end 22 dimensioned to fit snugly within passage 19 and an elongated shank 23. The spool-like inner end 22 has a rim or flange at both of its ends with the rim at its extreme inner end in engagement with the end wall of opening 18 within body 16, and with its other rim received within the annular recess 20. This latter flange may be folded over or rivetted into the annular recess 20 to fixedly secure the terminal 21 to body 16. A sealing material such as an epoxy resin is used to fill the annular recess 20 to provide a water tight seal between the terminal 21 and the body 16.

A movable metal contact 24 is slidably received within opening 18 in body 16. A shunt wire 25 extends between contact 24 and the inner end of terminal 21 and is soldered thereto to make an electrical connection between the contact 24 and terminal 21. A helical compression spring 26 surrounds shunt wire 25 with one end bearing against the inner end 22 of terminal 21 and the other end bearing against the movable contact 24. Spring 26 biases contact 24 upwardly, as seen in FIG. 1, and allows the contact 24 to slidably move within opening 18.

Electric fuse 7 is dimensioned to telescope within the cylindrical bodies 5 and 16. Fuse 7 has ferrule-like terminals at opposite ends thereof so that one of those terminals will extend into and be held by the clip 8 of the load side section 3 while the other of those terminals will abut the movable contact 24 within line side section 4.

As shown best in FIG. 3, plate 6 of load side section 3 includes a central opening 27 for receiving a machine screw 28. Opening 27 includes a counterbore **27*a* which shrouds the head of screw 28. Plate 17 of line side section 4 includes a central threaded opening 29 also dimensioned to receive screw 28. The openings 27 and 29 are positioned in alignment with one another so that when the sections 3 and 4 are assembled openings 27 and 29 are in registry with each other to receive screw 28. Further, the inner ends of bodies 5 of the load side section 3 are in registry with the central openings 18 in the bodies 16 of line side section 4**.

As shown best in FIGS. 1 and 3, the breakaway receptacle 2 of the fuseholder assembly shown includes a pair of spaced apart hollow sleeves 30 projecting from a housing 31. The sleeves 30 and housing 31 are molded as an integral unit from a flexible insulating material such as neoprene. Each sleeve 30 is hollow and includes a longitudinal opening 32 which houses a female terminal 33 having a tubular compression spring 34 at its upper end. Each opening 32 communicates with a cylindrical opening 35 which in turn communicates with the upper planar surface 36 of receptacle 2. The female terminals 33 are connected to line side wire conductors by means of any conventional wire connector (not shown).

The breakaway receptacle 2 is used as a mechanical link to physically interrupt a circuit upon an impact. Thus, when assembled the bodies 16 of fuseholder line side section 4 telescope into the openings 35 in housing 31 and the male line side terminals 21 telescope into and make sliding contact with the female receptacle terminals 33 within sleeves 30. It is this sliding contact between the terminals 33 and 21 which parts under impact to permit the fuseholder 1 to "break away" from the receptacle 2. The breakaway receptacle 2 is generally utilized for applications in breakaway lighting standards such as those required by state and federal highway regulations.

As a unique feature the fuseholder assembly of the present invention includes assembly means for polarizing the fuseholder sections 3 and 4 with respect to one another and for polarizing the attachment of the breakaway receptacle 2 to the line side fuseholder terminals 21. The assembly means ensures proper assembly of these components to avoid potentially hazardous conditions. Polarization is accomplished by providing a boss 37 integrally molded on the plate 17 of line side section 4. As shown best in FIG. 3, the boss 37 is located at the edge margin on one side of plate 17 and is positioned between the openings 18 and bodies 16. The boss 37 is located adjacent opening 29 in plate 17 and includes an upper portion 38 which projects upwardly from plate 17 and a lower portion 39 which projects downwardly from plate 17. As seen best in FIG. 2, boss 37 includes an inner surface 40, a pair of opposite side surfaces 41 and 42 and a rounded outer surface 43. The inner surface 40 and side surfaces 41 and 42 are planar in shape and side surfaces 41 and 42 form a 90° angle with respect to surface 40.

Figure 4:
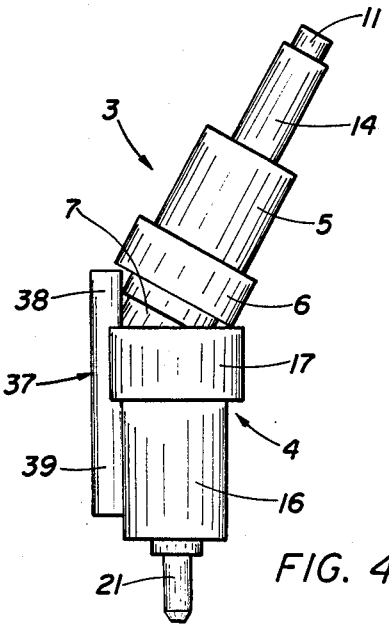
FIG. 4 is a schematic end view in elevation on a reduced scale showing the rejection of the fuseholder sections upon improper assembly.

A notch 44 is formed in the plate 6 of load side section 3 which is dimensioned to receive the upper portion 38 of boss 37 in mating relation. Thus, groove 44 includes a pair of opposite planar surfaces 45 and 46 and an inner planar surface 47 which forms a 90° angle with respect to one another. When the groove 44 receives the upper portion 38 of boss 37, the openings 27 and 29 are in registry with one another and the ends of bodies 5 of the load side section 3 are in registry with the openings 18 in the bodies 16 of the line side section 4. Thus groove 44 and upper portion 38 of boss 37 cooperate to permit the load side section 3 and line side section 4 of fuseholder 1 to move into a fully assembled relation only when groove 44 is in registry with boss 37. If either the load side section 3 or line side section 4 of fuseholder 1 has been inadvertently rotated 180° so that the groove 44 and boss 37 are not in registry with one another, the boss 37 will prevent the movement of sections 3 and 4 into their fully assembled relation, as shown in FIG. 4. This "rejection" is caused by the angular displacement of either section 3 or 4 from the longitudinal axis of fuseholder 1, and removes the alignment of openings 27 and 29 to prevent the entry of screw 28 into opening 29. As shown in FIG. 4, the angular displacement of sections 3 and 4 is sufficiently great to prevent entry of the fuses 7 into the openings 18 of section 4 so that electric contact is prevented between the terminals of the fuses 7 and the movable contact 24.

Boss 37 also provides for the polarization of the attachment of breakaway assembly 2 to line side fuseholder terminals 21. This is accomplished by forming a groove 48 in housing 31 of receptacle 2. Groove 48 is located between openings 35 and is of sufficient length to receive the lower portion 39 of boss 37. Groove 48 includes a pair of opposite planar side surfaces 49 and 50 and an inner surface 51 which forms a 90° angle with respect to one another to matingly receive the surfaces 40–42 of the lower section 39 of boss 37. Thus, when properly assembled the respective surfaces 51 and 40, 49 and 41, and 50 and 42 are all in opposing relation to one another. During assembly, if the lower portion 39 of boss 37 and the groove 48 are in registry with one another the fuseholder 1 and breakaway receptacle 2 may be moved into a fully assembled relation. However, if the lower portion 39 of boss 37 is not in registry with groove 48, such as when fuseholder 1 is inadvertently rotated 180°, boss 37 prevents fuseholder 1 and breakaway receptacle 2 from moving into their fully assembled positions. This is accomplished by causing an angular displacement of fuseholder 1 with respect to the longitudinal axis of receptacle 2 and removes the alignment of openings 35 in housing 31 with bodies 16 of section 4. Thus, the male terminals 21 of line section 4 are prevented from coming into contact with female receptacle terminals 33.

Fuseholder 1 may also include a means for rejecting non-class CC fuses, such as class G fuses. A class G fuse can have the same length and end cap diameter as a class CC fuse, but a lower current inturrupting rating. Thus, the purpose of this feature is to reject fuses having lower current interrupting capability.

Figure 5:
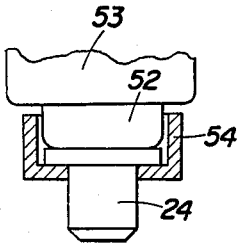
FIG. 5 is a detailed side view in elevation showing a first embodiment of a means for rejecting non-class CC fuses.

As shown in FIG. 5, a class CC fuse has a button 52 which measures about $\frac{1}{4}$ inch in diameter by about $\frac{1}{8}$ inch in length formed on the end surface of one of its end caps 53. As a means for rejecting non-class CC fuses, the movable contact 24 located in counterbore 18 includes an insulating ring formed on its end surface. The inside diameter of the insulating ring is sized to allow receipt of button 52 therein so that button 52 may engage the end surface of contact 24. The insulating ring prevents engagement of non-class CC fuses, such as class G fuses with contact 24 because of its inside diameter.

Figure 6:
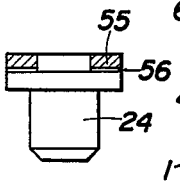
FIG. 6 is a detailed side view in elevation showing a second embodiment for a means for rejecting non-class CC fuses.
Figure 7:
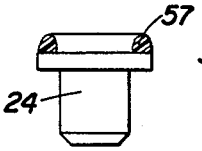
FIG. 7 is a detailed side view in elevation showing a third embodiment of a means for rejecting non-class CC fuses.
Figure 8:
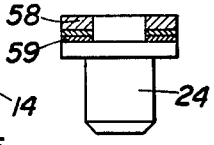
FIG. 8 is a detailed side view in elevation showing a fourth embodiment of a means for rejecting non-class CC fuses.

One embodiment of the insulating ring is shown in FIG. 5 which includes an annular spacer 54 staked or otherwise attached to contact 24. FIG. 6 shows a second embodiment which includes an annular washer 55 attached by a layer of adhesive 56 to the end surface of contact 24. FIG. 7 shows a third embodiment which comprises epoxy deposited in the form of a ring 57 on the end surface of contact 24. The epoxy may alternately also be deposited in the form of droplets on the peripheral portions of the end surface of contact 24. In this form there needs to be a minimum of two droplets arranged diametrically opposite one another. FIG. 8 shows a fourth embodiment which includes an annular washer 58 stamped from a sheet of copper clad printed circuit board. The washer 58 is attached to the end surface of contact 24 by positioning a thin preformed solder washer 59 between the washer 58 and contact 24 and then applying heat.

A fuseholder assembly has been shown and described which includes assembly means for ensuring proper polarity between fuseholder sections 3 and 4, and to polarize the attachment of a breakaway receptacle 2 to the line side fuseholder terminals 21. Various modifications and/or substitutions of the components specifically described herein may be made without departing from the scope of the present invention. For example, fuseholders and breakaway receptacles having different terminals from those specifically described herein may be utilized, and the boss 37 may have different configurations and be located at a different position from that specifically described herein.

Various modes of carrying out the invention are contemplated as being within the scope of the following claims particularly pointing out and distinctly claiming the subject matter which is regarded as the invention.

I claim:

1. In combination, a multi-pole fuseholder for supporting a plurality of in-line fuses in spaced apart relation, said fuseholder including a load side housing having a plurality of spaced apart terminals for connection to a plurality of load conductors, a line side housing having a plurality of spaced apart terminals, and fastening means engageable with said load and line side housings for releasably fastening said housing together to enclose a plurality of electric fuses in registry with said respective load and line conductors; a breakaway receptacle for releasably joining said line side terminals to corresponding line conductors, said breakaway receptacle includes a plurality of spaced apart insulating sleeves each housing a female terminal therein so that when assembled the line side terminals of said fuseholder telescope into the insulating sleeves of said receptacle and make sliding contact with the female terminals therein; and assembly means for insuring proper polarity between respective load and line conductors, said assembly means engageable between the load and line fuseholder housing and between the fuseholder and breakaway receptacle so that when said load and line side housings are initially moved into a position which would provide proper polarization for said load and line conductors said assembly means permits said housings to move into a fully assembled relation and when initially moved into a position which would provide improper polarization for said respective conductors said housings are prevented from moving into a fully assembled relation, and when said fully assembled fuseholder is initially moved into a position with said breakaway receptacle which would provide proper polarization for said load and line conductors said assembly means permits said fuseholder and breakaway receptacle to move into a fully assembled relation, and when initially moved into a position which would provide improper polarization said fuseholder and breakaway receptacle are prevented from moving into a fully assembled relation.

2. The combination of claim 1, wherein said assembly means includes key means on one of said housings, first key-receiving means formed in the other of said housings, and second key-receiving means formed in said breakaway receptacle.

3. The combination of claim 2, wherein said key means includes a boss integrally formed on said one housing, and said first and second key-receiving means includes a pair of respective grooves formed in the other of said housings and said breakaway receptacle.

4. The combination of claim 3, wherein said boss is formed on the line side fuseholder housing.

* * * * *